US008286707B2

(12) United States Patent
Schultz et al.

(10) Patent No.: US 8,286,707 B2
(45) Date of Patent: Oct. 16, 2012

(54) TREATING SUBTERRANEAN ZONES

(75) Inventors: Roger L. Schultz, Aubrey, TX (US); David J. Steele, Irving, TX (US); Travis W. Cavender, Angleton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 484 days.

(21) Appl. No.: 11/774,339

(22) Filed: Jul. 6, 2007

(65) Prior Publication Data

US 2009/0008096 A1 Jan. 8, 2009

(51) Int. Cl.
*E21B 43/24* (2006.01)
*E21B 36/00* (2006.01)

(52) U.S. Cl. ..... 166/303; 166/305.1; 166/57; 166/90.1

(58) Field of Classification Search ..... 166/90.1, 166/303

See application file for complete search history.

(56) References Cited

U.S. PATENT DOCUMENTS

| | | | | |
|---|---|---|---|---|
| 2,823,752 | A | 2/1958 | Walter | |
| 3,522,995 | A | 8/1970 | Erickson | |
| 3,548,938 | A * | 12/1970 | Parker | 166/256 |
| 3,980,137 | A * | 9/1976 | Gray | 166/256 |
| 3,982,591 | A * | 9/1976 | Hamrick et al. | 166/302 |
| 4,385,661 | A * | 5/1983 | Fox | 166/59 |
| 4,498,542 | A * | 2/1985 | Eisenhawer et al. | 166/303 |
| 4,682,471 | A * | 7/1987 | Wagner | 60/649 |
| 4,930,454 | A | 6/1990 | Latty et al. | |
| 6,988,549 | B1 | 1/2006 | Babcock | |
| 2005/0239661 | A1 | 10/2005 | Pfefferle | |
| 2007/0202452 | A1 * | 8/2007 | Rao | 431/354 |
| 2007/0237696 | A1 | 10/2007 | Payton | |
| 2010/0000221 | A1 * | 1/2010 | Pfefferle | 60/772 |

OTHER PUBLICATIONS

Notification of Transmittal of the International Search Report and the Written Opinion of the International Searching Authority (3 pages); International Search Report (5 pages); and Written Opinion of the International Searching Authority (6 pages) in related application PCT/US2008/068775, dated Feb. 22, 2009.

Notification Concerning Transmittal of International Preliminary Report on Patentability (1 page) and International Preliminary Report on Patentability (6 pages) mailed Jan. 21, 2010, for PCT/US2008/068775, filed Jun. 30, 2008.

Office Action mailed Apr. 10, 2012 in corresponding Canadian application No. 2,692,596 (2 pages).

* cited by examiner

*Primary Examiner* — Angela M DiTrani
(74) *Attorney, Agent, or Firm* — Fish & Richardson P.C.

(57) ABSTRACT

A system for treating a subterranean zone includes a combustion driven compressor in communication with a supply of a component of a combustion mixture. The compressor is configured to compress the component of the combustion mixture and has a combustion exhaust. A source of treatment fluid for treating the subterranean zone is coupled to the combustion exhaust to supply the treatment fluid in heat transfer communication with the combustion exhaust. In certain instances, compressor is driven by combusting the combustion mixture. In certain instances, the combustion mixture is combusted in separate combustor.

36 Claims, 9 Drawing Sheets

TREATING SUBTERRANEAN ZONES

TECHNICAL FIELD

This disclosure relates to treating subterranean zones using heated fluid.

BACKGROUND

Heated fluid, such as steam, can be injected into a subterranean formation to facilitate production of fluids from the formation. For example, steam may be used to reduce the viscosity of fluid resources in the formation, so that the resources can more freely flow into the well bore and to the surface. Generally, steam generated for injection into a well requires large amounts of energy such as to compress and/or transport air, fuel, and water used to produce the steam. Much of this energy is largely lost to the environment without being harnessed in any useful way. Consequently, production of steam has large costs associated with its production.

SUMMARY

The present disclosure encompasses treating a subterranean zone using heated fluid. In certain instances, the heated fluid can be introduced into the subterranean zone via a well bore or in another manner. The fluid is heated, in some instances, to form steam. The fluid is heated, at least in part, using heat recovered from compressing components of a combustion mixture or from another process. The heated fluid can be used to reduce the viscosity of resources in the subterranean zone and may enhance recovery of those resources.

One aspect encompasses a method for treating a subterranean zone. According to the method a treatment fluid is heated using heat recovered from an exhaust from compressing one or more components of a combustion mixture. The heated treatment fluid is provided into the subterranean zone. According to certain implementations, compressing one or more components of a combustion mixture can be performed before combusting the combustion mixture.

Another aspect encompasses a system for treating a subterranean zone. The system includes a combustion driven compressor in communication with a supply of a component of a combustion mixture. The compressor is configured to compress the component of the combustion mixture and has a combustion exhaust. A source of treatment fluid for treating the subterranean zone is coupled to the combustion exhaust to supply the treatment fluid in heat transfer communication with the combustion exhaust.

Another aspect encompasses a method whereby a treatment fluid is heated with heat recovered from a process on a terranean surface. The treatment fluid is then heated with a downhole combustor and provided into a subterranean zone.

The various aspects can include one or more of the following features. Heating the treatment fluid can include preheating the treatment fluid prior to a subsequent heating operation. The combustion mixture can be combusted in a downhole combustor and the treatment fluid can be further heated by this combustion. The heat can be recovered via a heat exchanger. The heat can be recovered by contacting the treatment fluid with the exhaust. The exhaust can be provided into the subterranean zone. The treatment fluid can be additionally heated using heat recovered from another process. One or more components of the combustion mixture can be compressed using a gas turbine compressor. The combustion mixture can be combusted in a gas turbine compressor. The heated treatment fluid can be in the form of steam. The combustion mixture can be conveyed downhole and the flow of one or more components of the combustion mixture can be ceased in response to the flow of treatment fluid. One or more conditions at a location in or near the subterranean zone can be monitored and at least one of the fuel flow, air flow, and treatment fluid flow can be adjusted based upon the one or more conditions at the location in or near the subterranean zone.

The details of one or more implementations are set forth in the accompanying drawings and the description below. Other features, objects, and advantages will be apparent from the description and drawings, and from the claims.

DETAILED DESCRIPTION

The present disclosure relates to treating a subterranean zone using heated fluid introduced into the subterranean zone via a well bore. The fluid is heated, in some instances, to form steam. The subterranean zone can include all or a portion of a resource bearing subterranean formation, multiple resource bearing subterranean formations, or all or part of one or more other intervals that it is desired to treat with the heated fluid. The fluid is heated, at least in part, using heat recovered from near-by operation. The heated fluid can be used to reduce the viscosity of resources in the subterranean zone to enhance recovery of those resources.

Figure 1:
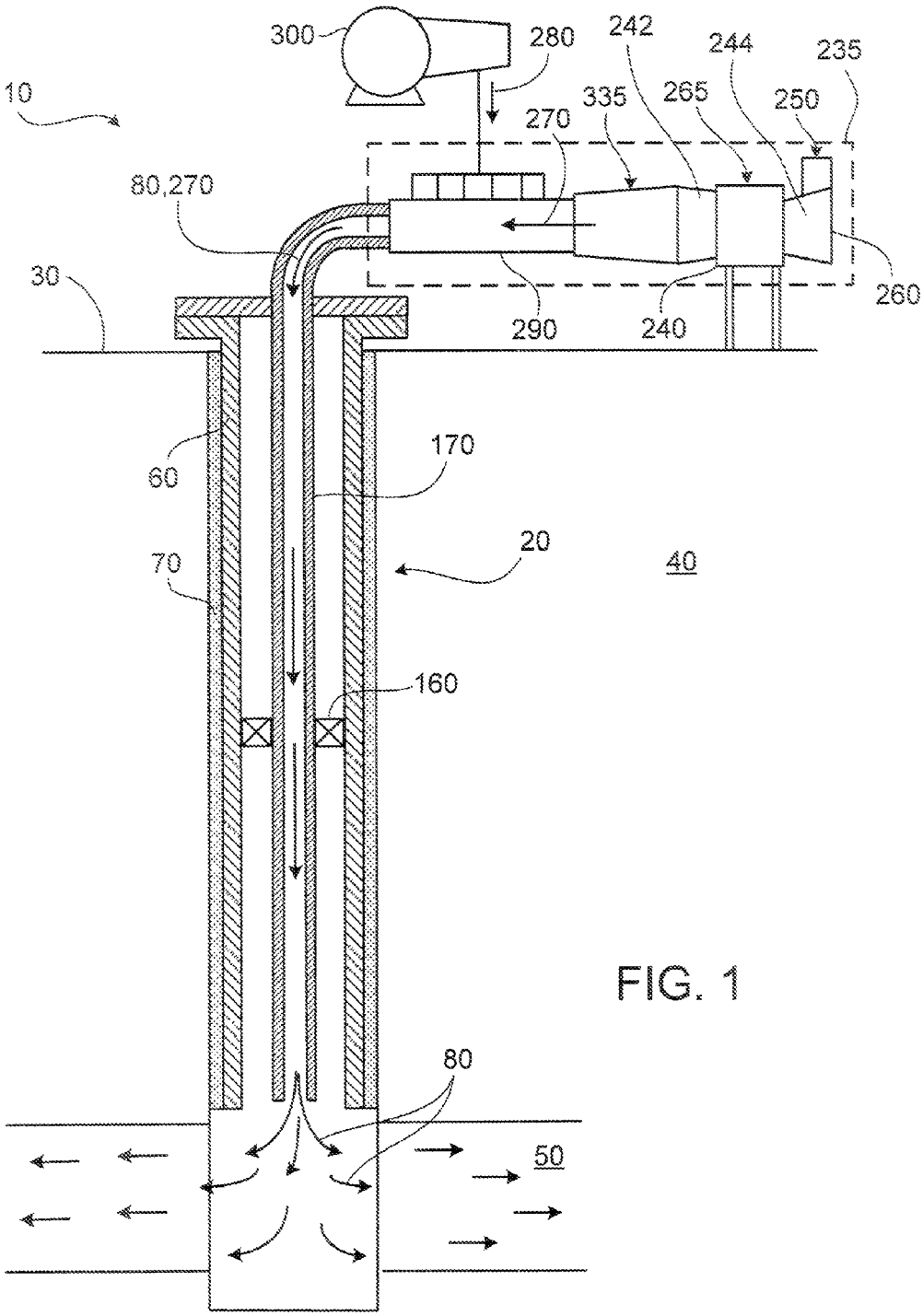
FIG. 1 shows a heated fluid generation system.

FIG. 1 shows a system 10 for treating resources in a subterranean zone for recovery using heated fluid that may be used in combination with other technologies for enhancing fluid resource recovery. In this example, the heated fluid comprises steam (of 100% quality or less). In certain instances, the heated fluid can include other liquids, gases or vapors in lieu of or in combination with the steam. For example, in certain instances, the heated fluid includes one or more of water, a solvent to hydrocarbons, and/or other fluids. In the example of FIG. 1, a well bore 20 extends from the terranean surface 30 and intersects a subterranean zone 50, although the well bore 20 may span multiple subterranean zones 50. A portion of the well bore 20 proximate to a subterranean zone 50 may be isolated from other portions of the well bore 20 (e.g., using packers 160 or other devices) for treatment with heated fluid at only the desired location in the subterranean zone 50. Alternately, the well bore 20 may be isolated in multiple portions to enable treatment with heated fluid at more than one location (i.e., multiple subterranean zones 50) simultaneously or substantially simultaneously, sequentially or in any other order. The length of the well bore 20 may be lined or partially lines with a casing 60. The casing 60 may be secured therein such as by cementing or any other manner to anchor the casing 60 within the well bore 20. As illustrated, the casing 60 is anchored by cement 70. However, the casing 60 may omitted within all or a portion of the well bore 20. Further, although the well bore 20 is illustrated as a vertical well bore, other configurations of well bores are within the scope of the present disclosure, such as articulated well bores, slant well bores, horizontal well bores, etc., and any combination thereof.

Figure 4:
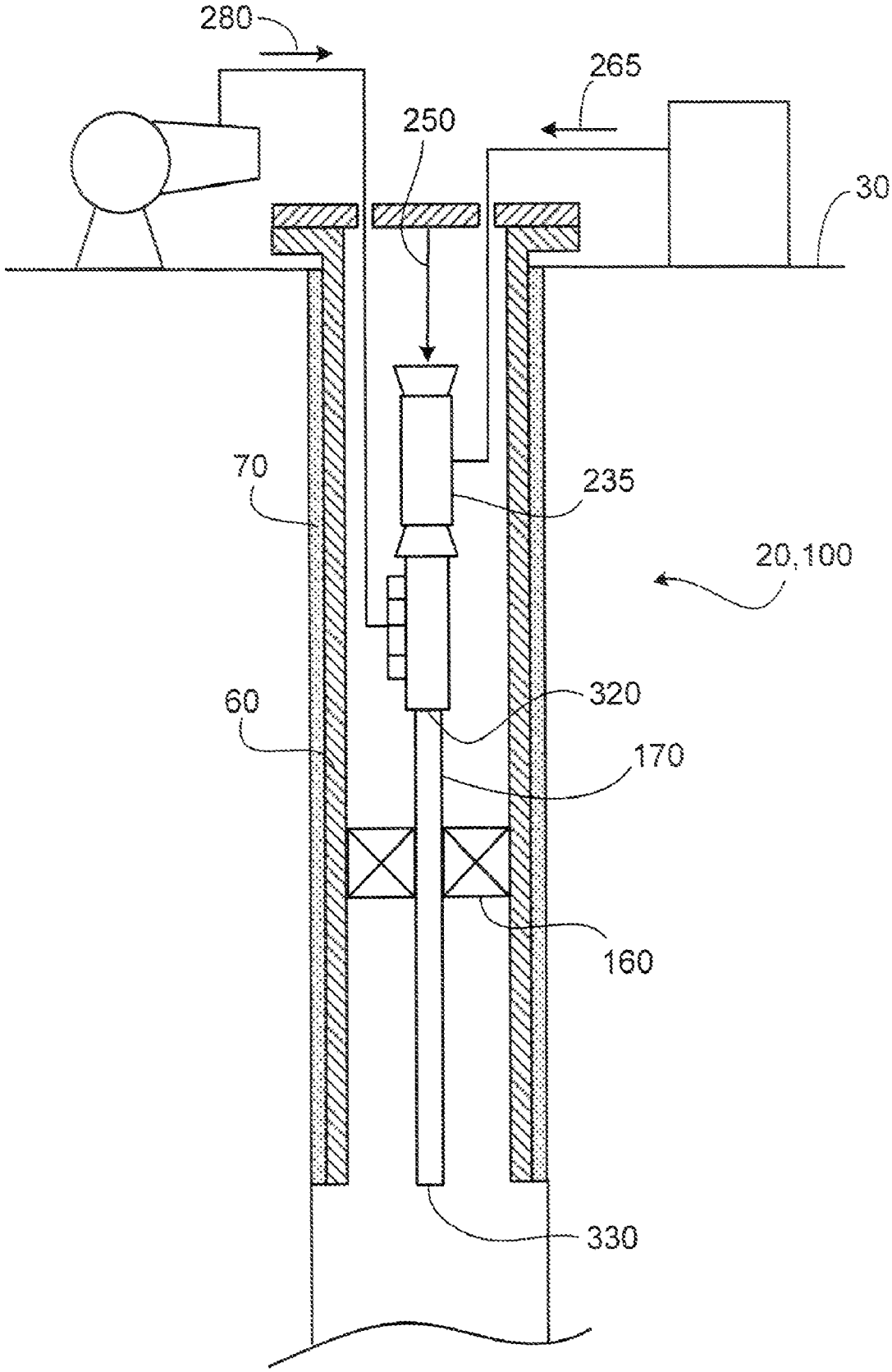
FIG. 4 shows a heated fluid generator disposed in a well bore.
Figure 5:
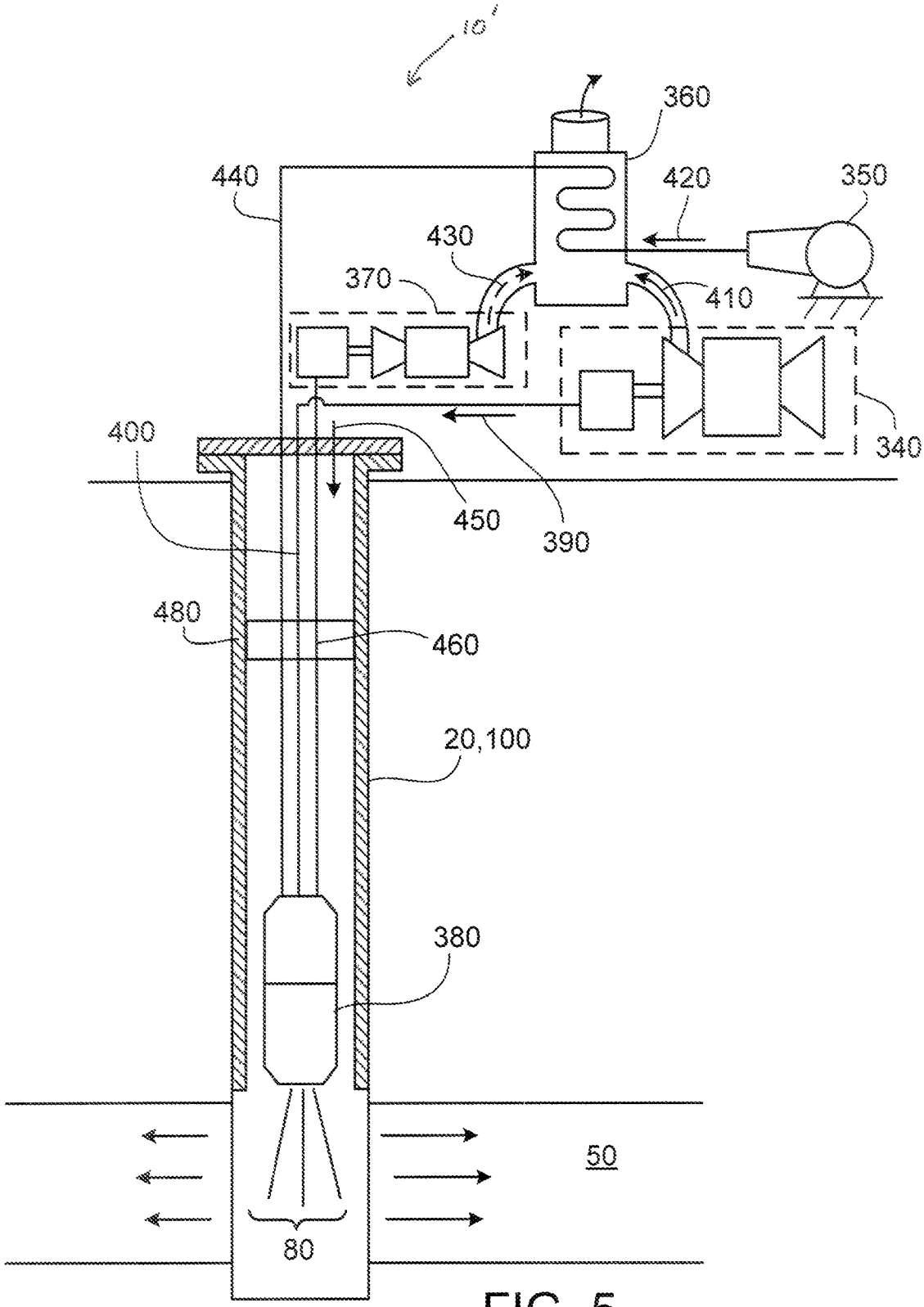
FIG. 5 shows a heated fluid generation system.

Heated fluid 80 may be introduced downhole within the well bore 20 proximate to the subterranean zone 50. The heated fluid 80 may be generated at the surface and pumped down the well bore 20 or the heated fluid 80 may be generated within the well bore 20, as shown in FIG. 5, described in more detail below. FIGS. 1, 4, and 5 show configurations suitable for use in a "huff and puff" process, where heated fluid is injected through the same bore in which resources are recovered. For example, the heated fluid may be injected for a specified period, then resources withdrawn for a specified period. The cycles of injecting heated fluid and recovering resources can be repeated numerous times. Additionally, the system and method of the present disclosure may be used in a Steam Assisted Gravity Drainage ("SAGD"), shown in FIG. 2.

Figure 2:
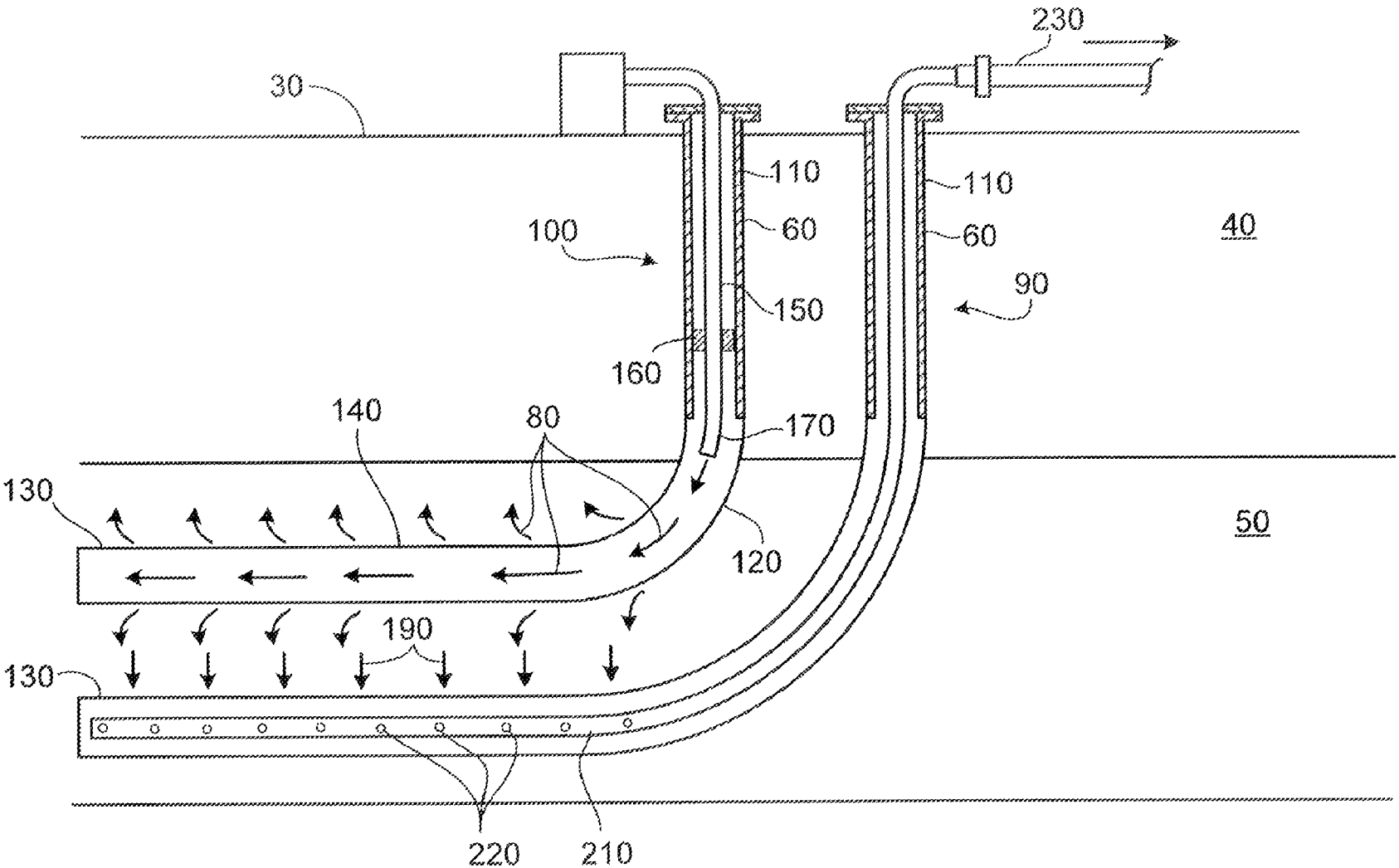
FIG. 2 illustrates a well bore configuration used in Steam Assisted Gravity Drainage.

As illustrated in the implementation of FIG. 2, SAGD includes a first well bore 90 and a second well bore 100. The well bores 90 and 100 are articulated well bores. That is, each well bore 90 and 100 includes two or more segments. In this case, the well bores 90 and 100 include a vertical or substantially vertical portion 110 (although the portion 110 may also be slanted or any other configuration), a curved portion 120, and a horizontal or substantially horizontal portion 130. Although described as horizontal, portion 130 may be slanted or of another configuration, for example, to follow the orientation of the subterranean zone 50. The well bores 90 and 100 may be lined with a casing 40. However, the well bores 20 may include longer or shorter casings 60 or no casing 60, for example, leaving some portion or all of well bore portion 103 open. The first and second well bores 90 and 100 are vertically offset, although it is within the scope of the present disclosure that the first and second well bores 90 and 100 be also laterally offset.

The second well bore 100 is divided into a first portion 140 and a second portion 150, although the second well bore 100 may be divided into multiple portions. The first and second portions 140 and 150 may be separated by a packer 160, for example, disposed within an annulus defined between the casing 60 (or an interior surface of the well bore 100 if no casing is included) and an injection string 170. In SAGD, heated fluid 80 is introduced into the second well bore 100 through the injection string 170. The heated fluid 80 is pressurized, such as to a pressure above the pressure of the subterranean zone 50, and injected into the first portion 160 of the second well bore 100. Consequently, the heated fluid 80 is forced into the subterranean zone 50, causing a reduction in the viscosity of the fluid resources contained therein. As a result of the lowered viscosity, the force of gravity causes at least a portion of the fluid resources (represented by arrows 190) to pass through the subterranean zone 50 and collect in the first well bore 90. A production string 200 disposed in the first well bore 90 includes conduit 210 having a plurality of apertures or slots 220 through which the production fluids may enter the production string 200. The fluid resources are then conveyed to the surface 30 through the production string 200. The fluid resources may then be conveyed through a pipeline 230 such as to a storage tank or any other location. The injection of heated fluid 80 may operate continuously while fluid resources are being recovered, or may be operated in cycles.

Referring again to FIG. 1, the system 10 (whether used in huff and puff, SAGD or another type of heated fluid treatment) includes a heated fluid generator 235 and a pump 300. The heated fluid generator 235 includes a compressor 240, such as a gas turbine compressor. According to some implementations, the compressor 240 includes a turbine 242 and a fan 244 joined by a shaft (not shown) extending through the compressor 240. Air 250 is drawn into an inlet end 260 of compressor 240 and subsequently compressed by the fan 244. Once compressed, the air is combined with a fuel 265 and combusted, forming an exhaust stream (referred to interchangeably as "exhaust") 270 that expands through the turbine 242. The expanding exhaust stream 270 causes the turbine 242 and, hence, the shaft and fan 244, to rotate. Thus, the compressor 240 is operable to generate mechanical energy via rotation of the shaft. The mechanical energy may be utilized to perform useful work, such as by coupling the shaft to a piece of equipment at the surface 30. In some implementations, the pump 300 is coupled to the shaft of the compressor 240. In some implementations requiring a high exhaust pressure, a portion of the exhaust stream 270 may be vented prior to expansion. In some implementations, the degree of compression in the fan 244 and expansion in the turbine 242 is selected to maintain the exhaust 270 at a pressure greater than the pressure needed to overcome the pressure at the subterranean zone 50.

Figure 3:
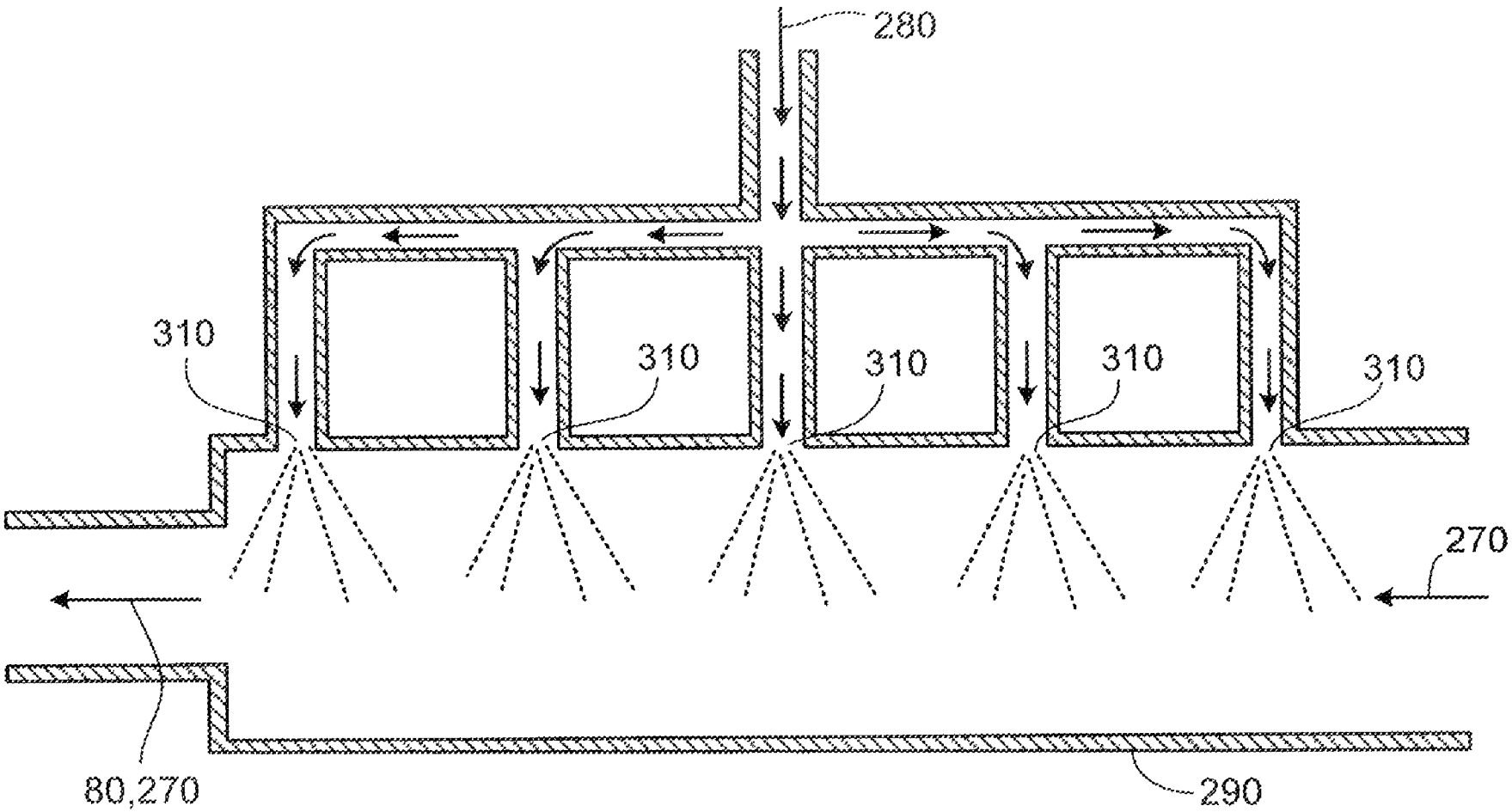
FIG. 3 shows a chamber for generating steam.

The exhaust stream 270 and a flow of treatment fluid 280 are introduced into a chamber 290. The treatment fluid 280 may be pressurized by a pump 300, such as a high-pressure pump, prior to being introduced into the chamber 290. The pump 300 may be a stand-alone pump or may be coupled to and driven by the shaft of the compressor 240. Further, the treatment fluid 280 may be atomized or introduced as a mist into the chamber 290 such as through a plurality of nozzles or openings 310 formed or installed in the chamber 290, as shown in FIG. 3. Once introduced into the exhaust stream 270, the treatment fluid is heated, and the resulting heated fluid 80, along with the exhaust 270, is introduced into the well bore 20 through the injection string 170 to the subterranean zone 50. In certain instances the treatment fluid 280 can include water and can be heated to become steam (of 100% quality or less).

In an SAGD application, the heated fluid 80 and exhaust 270 are introduced into the second well bore 100 through the injection string 170. Once introduced, the heated fluid 80 and exhaust 270 infiltrate the subterranean zone 50. The exhaust 270 contains carbon dioxide that also reduces the fluid resource's viscosity.

A choke, such as a choke valve, orifice plate, or any structure for controlling pressure and/or flow, may also be included at an outlet 320 of the heated fluid generator 235 and/or at an exit 330 of the injection string 170 to control the flow rate and/or output pressure of the heated fluid 80 and exhaust 270 (such as discussed below with respect to FIG. 6). In certain instances, the choke can be fixed or adjustable, and may be controlled from the terranean surface 30 (e.g., by a hydraulic, mechanical, electrical or other signal). Also, the exhaust stream 270 may be boosted by injecting and igniting fuel 335 in the exhaust stream 270. Additionally, as seen in FIG. 4, the heated fluid generator 235 can be configured with a diameter that enables the heated fluid generator 235 to be disposed within the well bore 20 or 100. For example, the heated fluid generator 235 can be located in the well bore 20 or 100 in or near the subterranean zone 50 being treated. Locating the heated fluid generator 235 in or near the subterranean zone 50 can reduce or eliminate heat losses associated with transporting the heated fluid 80 to the zone.

The system 10 can eliminate the need for a boiler at the surface to generate heated fluid, such as used in conventional operations (although the system 10 can be used in combination with a boiler, if desired). Such boilers tend to have a large footprint, i.e., tend to occupy large amounts of space at the surface. Consequently, elimination of the boiler increases useable space at the surface. Further, the system 10 also reduces or eliminates release of emissions directly into the atmosphere because the entire exhaust stream 270 can be injected into the subterranean zone 50. The system 10 also provides for improved heating efficiency of the subterranean zone 50, because essentially all of the heat generated during combustion of the fuel 265 is injected into the well bore 20 or 100.

FIG. 5 shows another system 10'. The system 10' includes the compressor 340, a pump 350, a heat exchanger 360 coupled to the compressor 340, and a fuel compressor 370. In certain embodiments, one or more of the compressor 340 and fuel compressor 370 can be turbine compressors similar to that described above or other types of compressors, including compressors powered by an internal combustion engine. The system 10' also includes a heated fluid generator 380. The heated fluid generator 380 shown in FIG. 5 is a downhole heated fluid generator, although the heated fluid generator 380 may additionally or alternatively include a surface based heated fluid generator. In certain embodiments, the heated fluid generator 380 can include a catalytic combustor that includes a catalyst that promotes an oxidization reaction of a mixture of fuel and air without the need for an open flame. That is, the catalyst initiates and sustains the combustion of the fuel/air mixture. Alternately (or additionally), the heated fluid generator 380 may include one or more other types of combustors. Some examples of combustors (but not exhaustive) include, a direct fired combustor where the fuel and air are burned at burner and the flame from the burner heats a boiler chamber carrying the treatment fluid, a combustor where the fuel and air are combined in a combustion chamber and the treatment fluid is introduced to be heated by the combustion, or any other type combustor. In some instances, the combustion chamber can be configured as a pressure vessel to contain and direct pressure from the expansion of gasses during combustion to further pressurize the heated fluid and facilitate its injection into the subterranean zone 50. Expansion of the exhaust gases resulting from combustion of the fuel and air mixture in the combustion chamber provides a driving force at least partially responsible for heating and/or driving the treatment fluid into a region of the well bore 20 at or near the subterranean zone 50. The heated fluid generator 380 may also include a nozzle at an outlet of the combustion chamber that, as explained above, may be configured as a pressure vessel. In certain implementations, for example, the heated fluid generator 380 may include a combustion chamber that operates in combusting and ejecting the combustion mixture in a manner similar to a rocket engine, such as a liquid or gaseous fuel rocket engine.

The compressor 340 generates a pressurized air stream 390 and conveys the air stream down the well bore 20 to the heated fluid generator 380 via a conduit 400. As the compressor 340 generates the pressurized air stream 390, a large quantity of heat is generated, such as from combustion of fuel in a gas turbine compressor or internal combustion engine. The heat may be output from the compressor 340 through an exhaust stream 410. As illustrated in FIG. 5, the exhaust stream 410 is conducted to the heat exchanger 360 where a portion of the heat energy is used to preheat a stream of treatment fluid, represented by arrow 420. Although the heat exchanger 360 is illustrated as receiving exhaust flows from compressor 340, the heat exchanger 360 may receive waste heat from any source, such as other internal combustion engines, turbine compressors or any type of device near-by the well bore. For example, waste heat in an exhaust stream 430 of the fuel compressor 370 may also be used to preheat the treatment fluid 420. Also, waste heat from a power plant used to drive the water pump 350 may also be used. Consequently, the system 10' utilizes otherwise wasted heat energy to preheat the treatment fluid 420 that is to be subsequently converted into steam within the well bore 20. Thus, the system 10' provides for improved efficiency by, for example, utilizing less fuel and air to generate an amount of heated fluid downhole. Alternately, if the amount of fuel and air are otherwise unchanged, the system 10' can provide an increased heated fluid output capability with little or no additional equipment and no additional fuel. Thus, the system 10' reduces costs associated with heated fluid generation.

The treatment fluid stream 420 is generated by the pump 350. In certain embodiments, pump 350 is a stand-alone pump or may be driven by the compressor 340, such as by being coupled to an output shaft of the compressor 340 (not shown). Alternately, the pump 350 may be coupled to and driven by the fuel compressor 370. The stream 420 then proceeds into the well bore 20 or 100 (in the case of SAGD), via conduit 440. The fuel compressor 370 generates a pressurized stream of fuel, represented by arrow 450 that is conveyed downhole via a conduit 460.

The streams of air, preheated treatment fluid, and fuel 390, 420, and 450 are conducted to the heated fluid generator 380 where the fuel and air are combined and combusted and the preheated treatment fluid is, consequently, converted into heated fluid 80. The heated fluid 80 and combustion products are then injected into the well bore 20, 100 in or near to the subterranean zone 50, where the combustion products and heated fluid 80 may infiltrate the subterranean zone 50. The subterranean zone 50 may be isolated or from other portions of the well bore 20, 100 by a packer 480, for example, or any other device for isolating a portion of a well bore. In certain configurations, system 10' provides an additional benefit of reducing a footprint of equipment needed to generate heat downhole.

Figure 6:
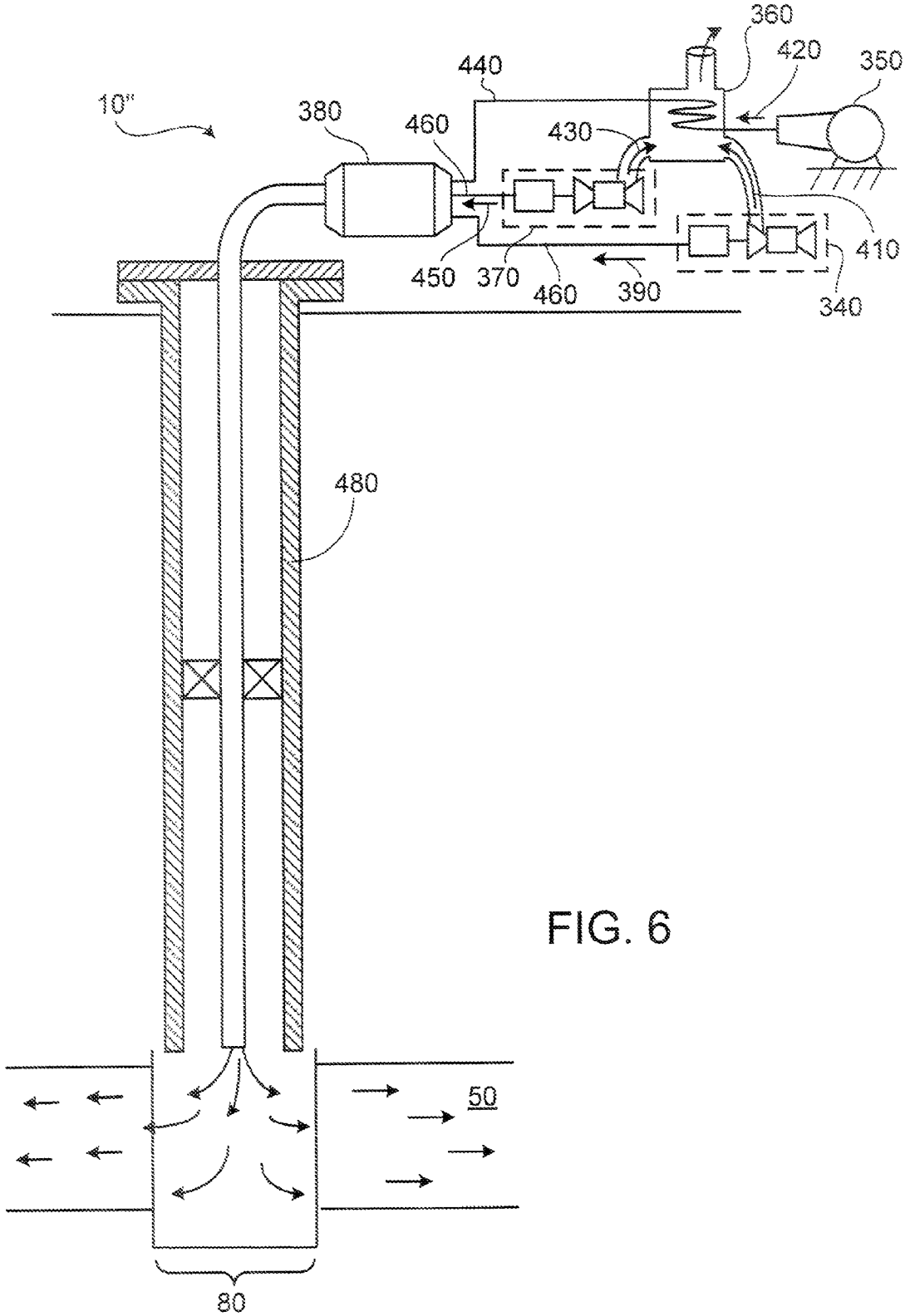
FIG. 6 shows another heated fluid generation system.

FIG. 6 shows a system 10" including the compressor 340, the pump 350, the compressor 340, the fuel compressor 370, and the heated fluid generator 380. The heat exchanger 360 may also be included to intake and transfer heat from one or more of the exhaust streams from the compressor 340 and the fuel compressor 370. In this instance, system 10" is similar to system 10', except that the heated fluid generator 380 is located at the surface, and the injection string 170 conducts the heated fluid 80 into the well bore 20, 100. According to other implementations, the heat exchanger 360 may be omitted. Thus, the treatment fluid stream 420 may be conducted from the pump 350 to the heated fluid generator 380 without passing through a heat exchanger, such as heat exchanger 360.

The pressurized air stream 390 from the compressor 340, the treatment fluid stream 420 from the pump 350, and the pressurized fuel stream 450 from the fuel compressor 370 are delivered to the heated fluid generator 380. As discussed above, waste heat from one or more of the compressor 340 and the fuel compressor 370 may be received into the heat exchanger 360 to preheat the treatment fluid stream 420 prior to being introduced into the heated fluid generator 380. As also described above, the fuel 450 and air 390 are combined and combusted and the treatment fluid 420 is converted into the heated fluid 80. The heated fluid 80 and combustion products are injected into the well bore 20, 100 and into or near the subterranean zone 50 via the injection string 170. The heated fluid 80 may then infiltrate the subterranean zone 50. Also, the subterranean zone 50 may be isolated or from other portions of the well bore 20, 100 by a packer 480.

Figure 7:
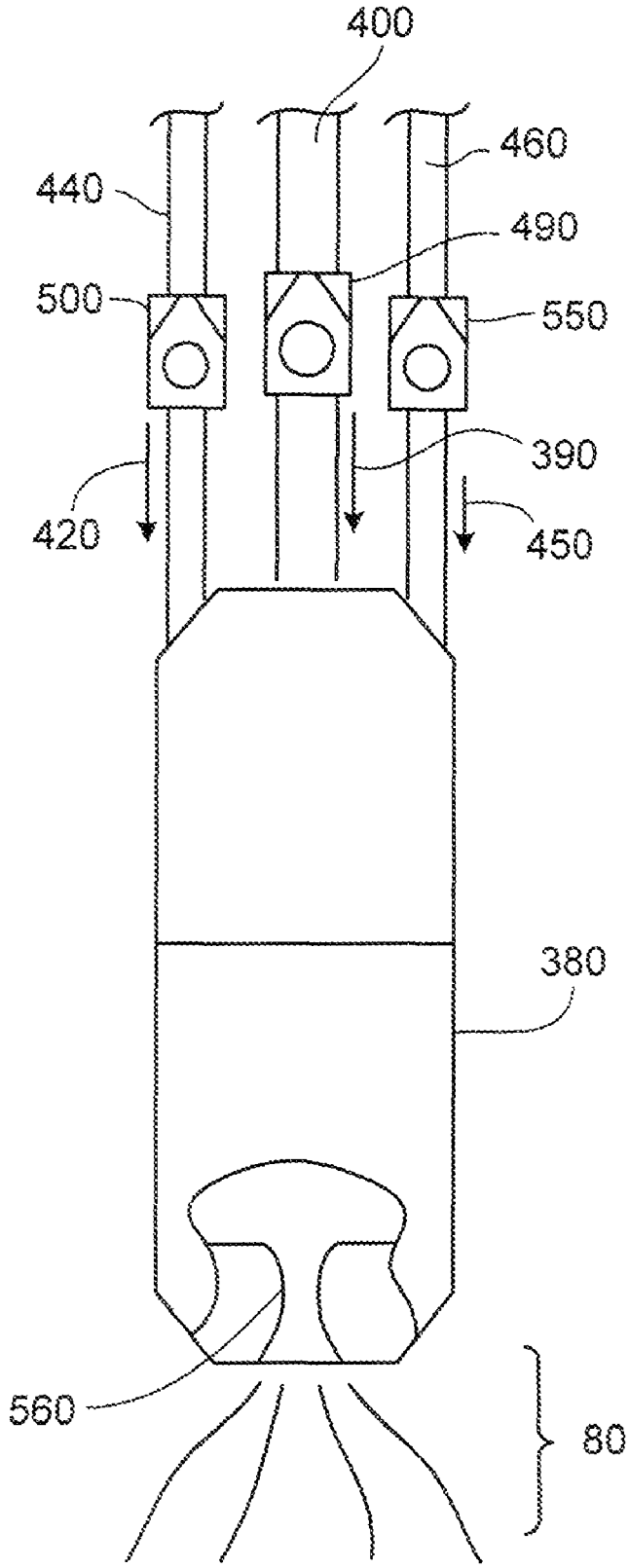
FIG. 7 is a detail view of a heated fluid generator disposed in a well bore.

Referring to FIG. 7, system 10' may also include one or more check or one-way valves on one or more of the conduits 400, 440, and 460, such as valves 490, 500, 550, respectively. The check valves prevent backflow of the air 390, treatment fluid 420, or fuel 450 or other fluids contained in the well bore 20, 100 and, therefore, provide for improved safety at a well site during heated fluid treatment. The valves 490, 500, or 550 may also be pressure operated check valves. For example, the valves 490 and 550 may be pressure operated valves that are maintained in an opened position, permitting the fuel and air streams 450 and 390, respectively, to flow to the heated fluid generator 380 so long as the treatment fluid 420 is maintained at a defined pressure. When the pressure of the treatment fluid 420 drops below the defined pressure, the valves 490 and 550 close, cutting off the flows of fuel and air. As a result, the combustion within heated fluid generator 380 is stopped. This can prevent destruction (e.g., burning) of the heated fluid generator 380 if the treatment fluid 420 is stopped. In such a configuration, water must be flowing to the heated fluid generator 380 in order for fuel and air to be permitted to flow to the heated fluid generator 380.

The heated fluid generator 380 may also include a choke 560. The choke 560 may be sized to produce a specified pressure or flow through the heated fluid generator 380, for example, to limit a back pressure of the heated fluid generator 380. Limiting back pressure enables operators to account for changing conditions within the subterranean zone 50 while heated fluid is being injected into the well bore 20, 100. Particularly, the backpressure within the well bore 20, 100 may change over time, against which the heated fluid generator 380 must operate. Therefore, the choke 560 provides for controlling an operating pressure of the heated fluid generator 380 to respond to changes in temperature and thermal conditions within the subterranean zone 50. Accordingly, the choke 560 may be selected or adjusted (e.g., adjusted remotely from the terranean surface or prior to placing the heated fluid generator 380 in the well bore 20, 100) to operate the heated fluid generator 380 within a range of operation tolerant to changes in the subterranean zone 50 and/or the well bore 20, 100. Once selected or adjusted, the heated fluid generator 380 and, therefore, the system 10', may have a more steady-state and predictable operation along with improved reliability. According to some implementations, the choke 560 may be a valve, such as mechanically or electrically operated valve controllable from the surface 30, a venturi, an orifice, or any structure for controlling pressure and/or flow.

Figure 8:
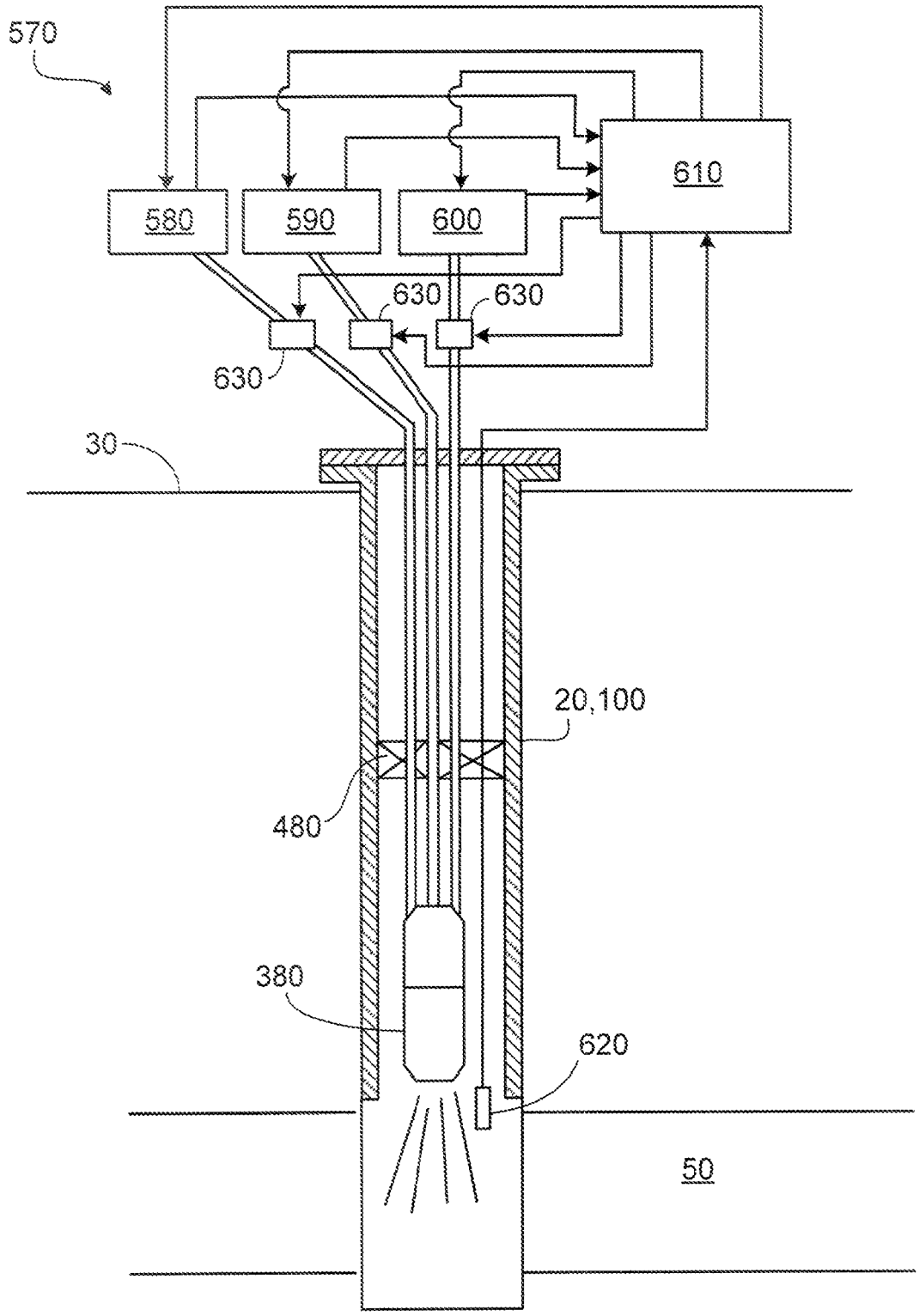
FIG. 8 shows a control system for controlling an operation of a heated fluid generation system.

FIG. 8 shows a feedback control system 570 to control operation of a heated fluid generation system. According to some implementations, the control system 570 may control the heated fluid generation system automatically, while, according to other implementations, the control system 570 may require user input to effect a change to the heated fluid generation system. As shown, the heated fluid generation system includes a fuel source 580, an oxidizer (e.g., air) source 590, a treatment fluid source 600, and a heated fluid generator, such as heated fluid generator 380. Each of the fuel, oxidizer, and treatment fluid sources 580, 590, and 600 includes equipment for conveying each, such as valves, pumps, and compressors. A controller 610 receives input from a sensor 620 disposed downhole to monitor conditions within the well bore 20, 100, such as temperature and pressure. According to some embodiments, the controller 610 may also receive inputs from the fuel, oxidizer, and treatment fluid sources, 580, 590, and 600 such as, for example, an output or operating pressure, an operating speed, and an operating temperature. However, it is within the scope of the present disclosure that the controller 610 does not receive inputs from the sources 580, 590, and 600 or that the controller 610 receives inputs from one or more of the sources and not from others, or the controller receives input from sources in addition to or other than the sources shown.

The controller 610 uses the inputs from the sensor 620 and optionally from the sources 580, 590, and 600 to operate the heated fluid generation system at a selectable operating point such as by adjusting operating parameters. For example, the controller 610 may adjust an amount of fuel, air, and water provided to the heated fluid generator 380 (via flow control devices 630 provided at the surface, as shown, or downhole) depending upon conditions sensed in the well bore 20, 100 by the sensor 620. The controller 620 may additionally or alternatively adjust other aspects, such as choke 560 (see FIG. 5). The controller 620 may use inputs from the sources 580, 590, and 600 to ensure that a change in the downhole condition requiring adjustments to the heated fluid generation system's performance would not exceed an operating parameter of a piece of equipment associated with the sources 580, 590, and 600. The controller 610 may continuously monitor the operation of the heated fluid generation system and the conditions downhole in order to maintain heated fluid generation at a desired level. For example, control may be effectuated and output of the heated fluid generator 380 by adjusted flow rates, temperatures, or pressures, such as by opening, closing, or adjusting a valve or adjusting a running speed or pressure of a pump or compressor, such as by increasing or decreasing an operating speed of the pump or compressor. In certain instances, the controller 610 may operate to optimize the operation of the heated fluid generator 380 based on specified operating parameters, for example, a specified amount of heated fluid production, a specified heated fluid temperature and/or subterranean zone temperature, a specified resource production rate from the subterranean zone, a specified amount of fuel consumption and/or other parameters. The controller 610 may be one or more of a Proportional, Integral, Derivative controller ("PID"); an observer-based controller, a state-variable controller, an adaptive controller or other type of control.

Figure 9:
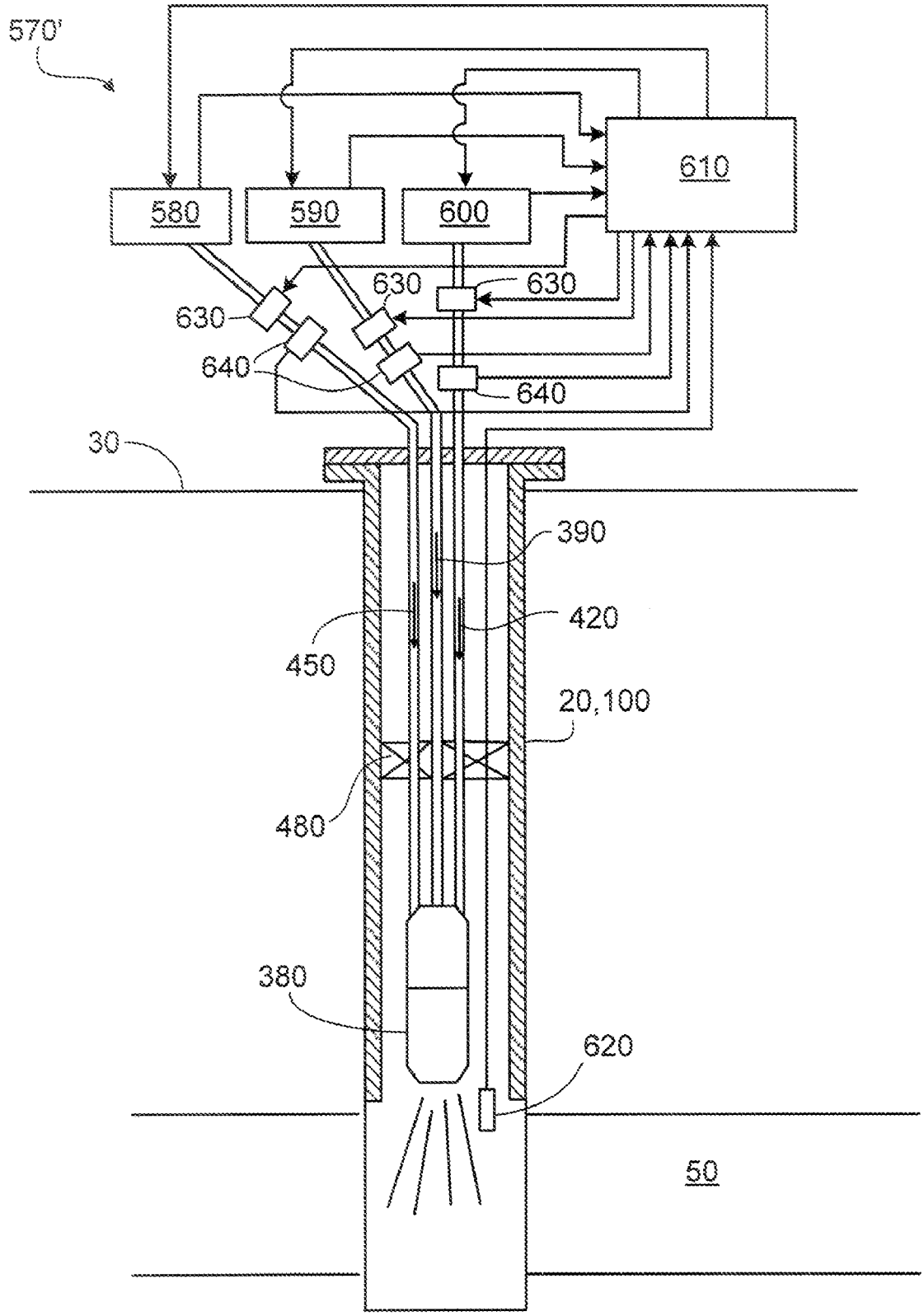
FIG. 9 shows another control system for controlling an operation of a heated fluid generation system.

FIG. 9 shows another implementation of the feedback control system, illustrated as feedback control system 570'. The feedback control system 570' may be used to control a heated fluid generation system including the fuel source 580, the oxidizer source 590, the treatment fluid source 600, the sensor 620, and the heated fluid generator 380. The control system 570' includes a flow control device 630 and a flowmeter 640. The flow control device 630 may be one or more of a valve, a compressor or pump. Further, although the flow control devices 630 are shown as separate components, the flow control devices 630 may form part of the sources 580, 590, and/or 600. For example, the flow control device 630 may be a pump that forms a part of the water source 600, and the running speed of the pump may be adjusted (e.g., by adjusting a speed of a motor driving the pump) to alter the flowrate of treatment fluid stream 420 fed to the heated fluid generator 380. Similarly, the flow control device 630 may be a compressor whose speed may be adjusted to modulate the flowrate of a fluid, such as the pressurized air stream 390 or the pressurized fuel stream 450.

According to some implementations, the controller 610 may detect a condition within the well bore 20, 100 via the sensor 620 as well as flowrates of the pressurized air stream 390, the treatment fluid stream 420, and the pressurized fuel stream 450 with the flowmeters 640. The controller 610 may utilize the transmitted data to monitor down hole heating conditions and, thus, the operation of the heated fluid generator 380. Consequently, the controller 610 may transmit signals to one or more of the flow control devices 630 to adjust the flowrate of one or more of the streams 390, 420, and 450 in response to the down hole conditions within the well bore 20, 100, for example, to maintain a condition within the well bore 20, 100 at a selected level.

According to other implementations, the sensor 620 may be omitted and control of down hole conditions within the well bore 20, 100 may be controlled, at least in part, with the data provided by the flowmeters 640. For example, the controller 610 may utilize the flowrate data to monitor operation of the heated fluid generator 380 and, consequently, a heating condition within the well bore 20, 100. With the flowrate data and other information, such as, the type of oxidizer 390, treatment fluid 420, and fuel 450 being utilized, the controller 610 is operable to determine an operating condition of the heated fluid generator 380 and, hence, a heating condition within the well bore 20, 100. According to other implementations, other data may be provided to the controller 610 by other surface instrumentation, such as pressure and temperature sensor monitoring one or more of the streams 390, 420, and 450.

A number of implementations have been described. Nevertheless, it will be understood that various modifications may be made without departing from the spirit and scope of the disclosure. Accordingly, other implementations are within the scope of the following claims.

What is claimed is:

1. A method for treating a subterranean zone, the method comprising:

pre-heating a treatment fluid using heat recovered from a combustion exhaust output from a device that drives a compressor used in compressing one or more components of a combustion mixture, the combustion exhaust applied to the treatment fluid to heat the fluid;

providing the pre-heated treatment fluid and the one or more compressed components to a combustor; and combusting the compressed components in the combustor and further heating the pre-heated treatment fluid to generate steam.

2. The method according to claim 1, wherein the heat is recovered at least in part via a heat exchanger.

3. The method according to claim 1, wherein the heat is recovered at least in part by contacting the treatment fluid with the exhaust.

4. The method according to claim 1, wherein providing the pre-heated treatment fluid and the one or more compressed components to a combustor comprises providing the pre-heated treatment fluid and the one or more compressed components to a downhole combustor adjacent a subterranean zone.

5. The method according to claim 1, further comprising heating the treatment fluid using heat recovered at least in part from another process.

6. The method according to claim 1, wherein one or more components of the combustion mixture are compressed using a gas turbine compressor.

7. The method according to claim 1, further comprising combusting the combustion mixture in a gas turbine compressor.

8. The method according to claim 1, further comprising conveying the combustion mixture downhole and ceasing a flow of one or more components of the combustion mixture in response to the flow of treatment fluid.

9. The method according to claim 1 further comprising:

conveying a fuel flow and an air flow to a location for combustion;

conveying a treatment fluid flow to a location proximate to the combustion location;

monitoring one or more conditions at a location in or near the subterranean zone; and adjusting at least one of the fuel flow, air flow, and treatment fluid flow based upon the one or more conditions at the location in or near the subterranean zone.

10. The method according to claim 1, wherein the combustion exhaust applied to the treatment fluid to heat the fluid comprises combustion exhaust directly mixed with the treatment fluid.

11. The method according to claim 1, wherein the combustion exhaust is applied to an aqueous treatment fluid.

12. A system for treating a subterranean zone, comprising:

a combustion driven gas turbine compressor in communication with a supply of a component of a combustion mixture, the compressor configured to compress the component of the combustion mixture and having a combustion exhaust output from the combustion driven compressor;

a source of treatment fluid for treating the subterranean zone, the source coupled to the combustion exhaust output from the combustion driven compressor to apply the combustion exhaust to the treatment fluid; and a conduit operable to supply the treatment fluid and the combustion exhaust into a well bore, the treatment fluid comprising steam.

13. The system according to claim 12, wherein the compressor is driven by combustion of the combustion mixture.

14. The system according to claim 13 further comprising a control system comprising:

a sensor disposed in or near the subterranean zone; and a control unit operable to control operation of the combustor based on conditions sensed by the sensor.

15. The system according to claim 12, further comprising a combustor in communication with the compressor to receive and combust the combustion mixture and in communication with the source of treatment fluid to heat the treatment fluid.

16. The system according to claim 15, wherein the combustor is a downhole combustor.

17. The system according to claim 16, further comprising a check valve between the compressor and the combustor configured to prevent flow of one or more components of the combustion mixture away from the combustor.

18. The system according to claim 16, further comprising a valve between the compressor and the combustor configured to cease a flow of one or more components of the combustion mixture based on the flow of treatment fluid.

19. The system according to claim 15, wherein the combustor comprises a restriction at an outlet thereof.

20. The system according to claim 19, wherein the restriction is adjustable from a terranean surface when the combustor is downhole.

21. The system according to claim 12, wherein the compressor is configured to reside in a well bore.

22. The system according to claim 12, further comprising a second combustion driven compressor having a combustion exhaust; and wherein the treatment fluid source is coupled to the combustion exhaust of the second compressor.

23. The system according to claim 12, wherein the combustion exhaust output from the combustion driven compressor is directly contacted with the treatment fluid.

24. The system according to claim 12, wherein the combustion exhaust output from the combustion driven compressor is applied to the treatment fluid in a heat exchanger.

25. A method, comprising:

pre-heating a treatment fluid with heat recovered from combustion exhaust output from a process on a terranean surface, the combustion exhaust output generated from a combustion mixture and applied to the treatment fluid;

supplying one or more components of the process and the treatment fluid to a combustor;

further heating the treatment fluid with the combustor; and providing the further heated treatment fluid into a subterranean zone, the further heated treatment fluid comprising steam.

26. The method according to claim 25, wherein the process comprises compressing at least one of air or fuel used in the combustor.

27. The method according to claim 25, wherein pre-heating the treatment fluid comprises pre-heating the treatment fluid by mixing the exhaust from the process on the terranean surface with the treatment fluid.

28. The method according to claim 25, further comprising controlling the combustor based on conditions sensed in or near the subterranean zone.

29. The method according to claim 25, wherein pre-heating the treatment fluid comprises pre-heating the treatment fluid on the terranean surface.

30. The method according to claim 25, wherein the combustor comprises a downhole combustor insertable into a wellbore.

31. The method according to claim 25, wherein the one or more components of the process comprise compressed fuel and compressed air.

32. The method according to claim 25, wherein the combustion exhaust is output from a gas turbine compressor.

33. A method for treating a subterranean zone, the method comprising:

heating, at a terranean surface, a treatment fluid using heat recovered from a combustion exhaust output from a gas turbine that drives a compressor used in compressing one or more components of a combustion mixture, the combustion exhaust applied to the treatment fluid to heat the treatment fluid; and providing the heated treatment fluid and the combustion exhaust into the subterranean zone, the heated treatment fluid comprising steam.

34. The method according to claim 33, wherein the heat is recovered at least in part by contacting the treatment fluid with the exhaust.

35. The method according to claim 33, wherein the heat is recovered at least in part via a heat exchanger.

36. The method according to claim 33, wherein providing the heated treatment fluid and the combustion exhaust into the subterranean zone comprises providing a mixture of the heated treatment fluid and the combustion exhaust into the subterranean zone.

* * * * *